US008353190B2

(12) United States Patent
Hackenberg

(10) Patent No.: US 8,353,190 B2
(45) Date of Patent: Jan. 15, 2013

(54) METHOD AND DEVICE FOR WINDING METAL STRIPS ONTO A COILING MANDREL

(75) Inventor: Wolfgang-Dietmar Hackenberg, Freudenberg (DE)

(73) Assignee: SMS Siemag AG, Duesseldorf (DE)

( * ) Notice: Subject to any disclaimer, the term of this patent is extended or adjusted under 35 U.S.C. 154(b) by 933 days.

(21) Appl. No.: 12/442,803

(22) PCT Filed: Sep. 25, 2007

(86) PCT No.: PCT/EP2007/008285

§ 371 (c)(1),
(2), (4) Date: Mar. 25, 2009

(87) PCT Pub. No.: WO2008/037408

PCT Pub. Date: Apr. 3, 2008

(65) Prior Publication Data

US 2010/0083720 A1 Apr. 8, 2010

(30) Foreign Application Priority Data

Sep. 25, 2006 (DE) ..... 10 2006 045 609
Sep. 24, 2007 (DE) ..... 10 2007 045 698

(51) Int. Cl.
*B21B 37/48* (2006.01)
*B21C 47/00* (2006.01)

(52) U.S. Cl. ..... 72/8.6; 72/12.3; 72/146

(58) Field of Classification Search ..... 72/8.6, 72/12.3, 146, 148, 365.2
See application file for complete search history.

(56) References Cited

U.S. PATENT DOCUMENTS

| | | | | |
|---|---|---|---|---|
| 3,581,536 | A | 6/1971 | Terwilliger | 72/9 |
| 4,463,586 | A | 8/1984 | Griffin | 72/17 |
| 4,972,706 | A | 11/1990 | Adolfsson | 73/159 |
| 5,961,022 | A | 10/1999 | Pfeiffer | 226/176 |
| 6,070,472 | A | 6/2000 | Kipping | 73/829 |
| 6,729,757 | B2 | 5/2004 | Faure | 374/50 |
| 7,059,161 | B2 | 6/2006 | Armenat | 72/117 |
| 2004/0244450 | A1 * | 12/2004 | Armenat et al. | 72/11.7 |

FOREIGN PATENT DOCUMENTS

| | | |
|---|---|---|
| UA | 40444 A | 7/2001 |
| WO | WO 00/41823 | 7/2000 |

* cited by examiner

*Primary Examiner* — Teresa M Ekiert
(74) *Attorney, Agent, or Firm* — Andrew Wilford

(57) ABSTRACT

A method and a device for winding metal strip onto a mandrel to which the metal strip is fed by a driver encompassing a bottom and a top drive roller in a driver frame. In order to regulate the driver in such a way by measuring the strip tension, the longitudinal tensile strength applied to the metal strip by the driver to control the strip run through the driver is determined by means of a strip tension measuring device which is mounted on the driver frame, in a pivot located shortly behind the bottom drive roller, and can be swiveled into the metal strip from below. The strip tension measuring device is composed of a first lever arm and a second lever arm which is hingedly mounted at the front of the first lever arm and the forward end of which is provided with a roller.

12 Claims, 4 Drawing Sheets

METHOD AND DEVICE FOR WINDING METAL STRIPS ONTO A COILING MANDREL

CROSS REFERENCE TO RELATED APPLICATIONS

This application is the US national phase of PCT application PCT/EP2007/008285, filed 25 Sep. 2007, published 3 Apr. 2008 as WO2008/037408, and claiming the priority of German patent application 102006045609.2 itself filed 2 Sep. 2006 and PCT patent application PCT/EP2007/008285 itself filed 25 Sep. 2007, whose entire disclosures are herewith incorporated by reference.

The invention relates to a method of and an apparatus for winding metal strips onto a mandrel arranged in a coiler, to which the metal strip is fed by a feeder having an upper and a lower feed roller in a feeder frame, a lower guide plate being provided below the metal strip, and an upper guide plate and a swiveling guide flap being arranged above the metal strip, the guide flap being provided on the upper guide plate near the mandrel.

A feeder or feeding device known from DE 195 20 709 [U.S. Pat. No. 5,961,022] has a lower roll mounted so as to be stationary and an upper roller adjustable relative thereto. The adjustable upper roller is supported in a pivotal frame that is adjustable by fluid-actuated cylinders, the pivotal frame being formed by two spaced arms that are connected together at a common pivot axis by a base supported at both ends in the feeder frame. The arms of this feeder are adjustable by respective separately operable fluid-actuated cylinders, the base connecting the arms to one another being formed as a torque spring.

By applying slightly different adjusting forces to the fluid-actuated cylinders it is possible here to set different pivot angles of the arms and thus of the adjustable upper feeder or feed roller. By pivoting the upper roller, the tension applied by the feeder to the strip can be influenced and in this manner a distribution of tension adjusted. The forces in the adjusting cylinders of the upper feed roller (controller) on the drive and operator sides can in fact be preset differently. The tension difference in the metal strip is thus set at the feeder to vary across the strip width and the strip travel can thus be influenced.

When winding metal strips, in particular hot metal strips, winding errors often occur in the form of cyclical or approximately cyclical misalignments of the individual turns during the entire winding operation. Traveling untrue is not acceptable, since projecting turns can be easily damaged during further transport. The main cause of these winding errors can be found in the non-planarity of the strip, which during winding in the winding apparatus can lead to strip movement crosswise of the transport direction.

A measuring roller for measuring the planarity of a rolled strip under tension in a hot-strip rolling train is known from DE 197 04 447 [U.S. Pat. No. 6,070,472]. One or more of these measuring rollers, which are pressed against the rolled strip from below, can be provided between the roll stands of the finishing train and/or in the rolling direction downstream of the last roll stand of the finishing train and/or upstream of a feeder for a coiler and/or between the feeder and the coiler. In the case of a measuring roller provided between the feeder and the coiler, the value obtained can be used for pivoting the feeder and in this manner the strip travel can be controlled during winding on the coiler or mandrel.

A thin-strip coiler with flatness-measuring roller for measuring and influencing the flatness of strip material in the coiler of a hot-strip mill is known from DE 101 31 850 [U.S. Pat. No. 7,059,161]. The flatness-measuring roller is provided here in the coiler between the feeder as well as the mandrel and moveable as well as fixed strip guides there. The flatness-measuring roller is moved out of a working position in which the hot strip is guided around the flatness-measuring roller while maintaining a more or less constant contact angle, into a lowered position in which the flatness-measuring roller is protected in the coiler by a pivotal strip guide.

The object of the invention is to further develop a method and an apparatus of the type mentioned above in that an improved tension measurement of a metal strip in the coiler can be achieved, in particular to make possible a strip tension difference that can be used for influencing the feeder so that a square-ended coil can be formed.

This object is attained with a method according to the invention in that the longitudinal tension applied by the feeder to the metal strip used to control the strip travel through the feeder is determined by a strip-tension sensor mounted on the feeder frame at a pivot axis located just downstream of the lower feed roller and can be pivoted into the metal strip from below. As a result of the strip-tension sensor thus pivotally supported in the feeder itself, namely in the feeder frame, which sensor can thus take measurements immediately downstream of the feeder gap, a tool is available that offers the operator of the system various advantages. These include the ability to influence of the strip travel during the winding operation between the feeder and the mandrel for improved edge straightness of the coil, by measuring on the metal strip more process information, e.g. size of the center and edge waviness characteristics, advantageous feedback of the results of the measurement to the control of the upstream finishing train (profile and flatness) and the cooling zone as well as a quality monitoring of the product. Furthermore, due to the short path, measurement is also possible at the trailing strip end, which is important because here handling the strip is particularly difficult because no more tension is applied to the strip by the finishing stage of the roll train.

It is proposed according to the invention that the wedge portion of the strip tension distribution is measured over the width of the metal strip, optionally and if necessary the position of the edges of the metal strip also taken into account at the same time. The strip-tension sensor permanently measures the strip tension distribution with respect to the non-planarity of the strip. The data obtained are prepared in an evaluating computer and a corresponding target value is transmitted to the feed roller machinery or controller.

According to an advantageous proposal of the invention, the strip-tension sensor is pivoted immediately after the generation of the strip tension under the metal strip between the feeder and the mandrel in a controlled manner, for example, by a hydraulic cylinder acting on at least one end of the pivot axis of the strip-tension sensor. The necessary strip tension is usually achieved after two to three turns of the mandrel. As long as there is no metal strip between the feeder and the mandrel, i.e. in the starting position, the strip-tension sensor is pivoted away. As soon as the strip tip has passed through the feeder gap and strip tension has built up, the hydraulically controlled pivoting against the lower face of the metal strip takes place.

According to a preferred embodiment of the invention, the strip-tension sensor forms a contact angle with a roller engaging downward into the metal strip. This ensures the transmission of force from the metal strip to the measurement roller and from there to the force measurer integrated into the strip-tension sensor.

When the strip-tension sensor is preferably pivoted into the metal strip up to a predetermined fixed position advantageously accounting for the entire coil diameter, the metal strip, as with the looper operation, in the finishing train is deflected so that at the end of the strip a still optimal contact angle can also be produced at the leading roller or measuring roller of the strip-tension sensor.

This is further promoted when with the pivoting in of the strip-tension sensor and downward engagement of the measuring roller into the metal strip from above, a counter-pressure means (counter-pressure roller) is pivoted against the metal strip. Just before the end of the strip leaves the feeder gap, the measurement is ended and the strip-tension sensor and the counter-pressure means are moved back to their starting positions.

According to a further embodiment of the invention, the peripheral speed of the measurement roller and preferably is matched to the speed of the metal strip before the pivoting in. Since the roller is pivoted against the strip during the winding process, through the advance speed synchronization damage of the metal strip by a later acceleration process otherwise necessary can be avoided. The drive can be carried out mechanically and/or electrically and/or hydraulically.

An apparatus for attaining the object of the invention is based is characterized according to the invention in that the strip-tension sensor comprises an inner arm supported at its inner end at a pivot axis on the feeder arm and an outer arm supported in a pivoted manner on the outer end of the inner arm, which outer arm has a roller on its outer end, a force sensor, preferably pressure sensors such as pressure measuring cells being provided between the inner arm and the outer arm. As soon as the strip-tension sensor is pivoted into the metal strip and engages with its leading measuring roller forming a contact angle, a force is applied to the roller which acts on the outer arm in a clockwise direction. The forces developing on the roller through the strip tension are in this manner transmitted in a very low-friction manner to the pressure sensor integrated in the inner arm supported on the feeder frame and transmitted to the feeder controller that, for example, corrects the strip travel by pivoting the upper feed roller.

The formation of the contact angle can be favorably affected when according to a preferred embodiment of the invention a counter-pressure roller that can be pivoted onto the metal strip from above is provided for the strip-tension sensor. It can be supported advantageously at the upstream end, near the upper feed roller, of the upper guide plate that is present anyway.

Further features and details of the invention are seen in the claims and the following description of an illustrated embodiment of the invention shown in the drawings. Therein:

Figure 1:
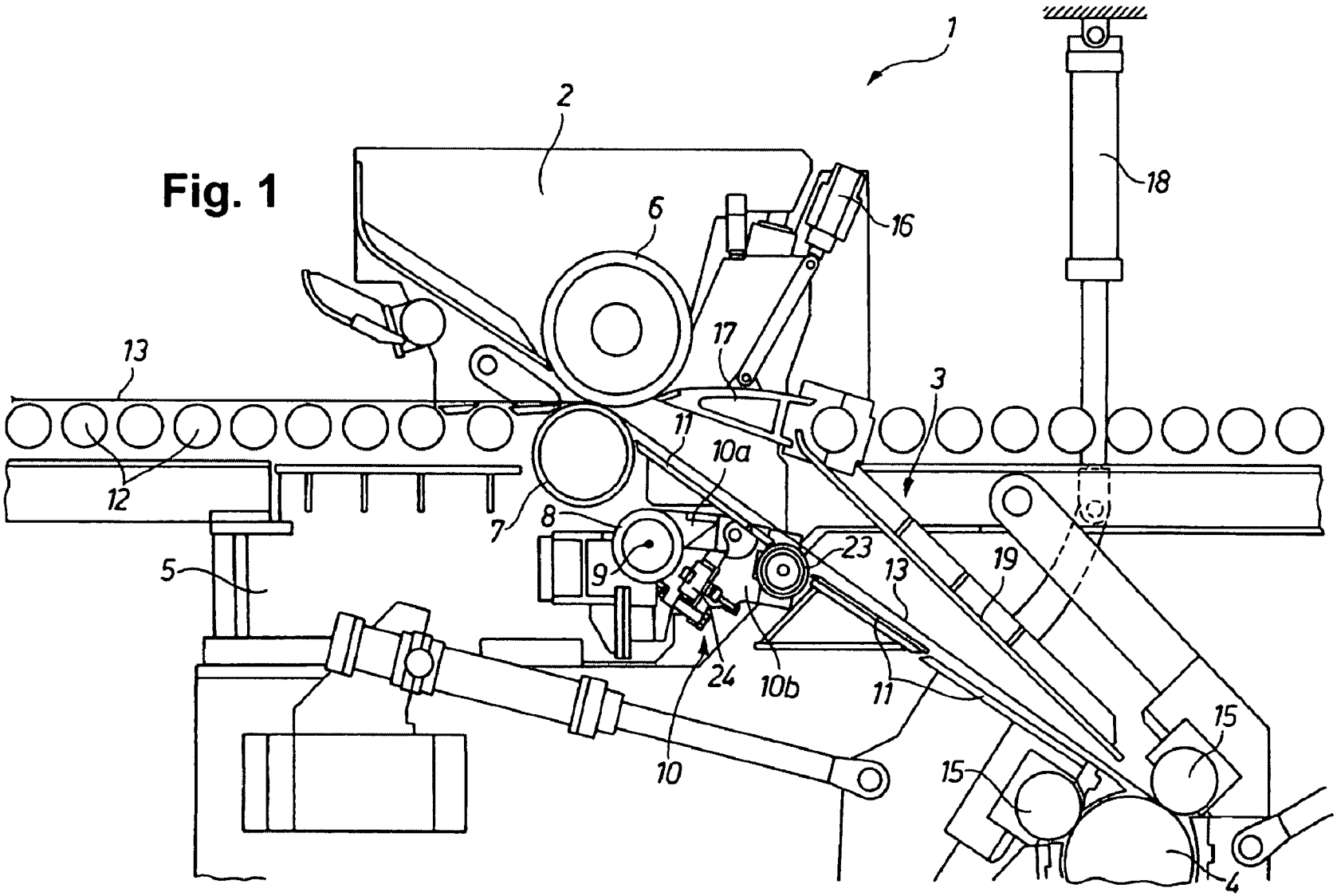
FIG. 1 shows a winding apparatus with a strip-tension sensor provided in the coiler pivotally supported on the feeder, which is in the out-of-use position pivoted away from the metal strip to be wound up, shown in a partly sectional side view.
Figure 2:
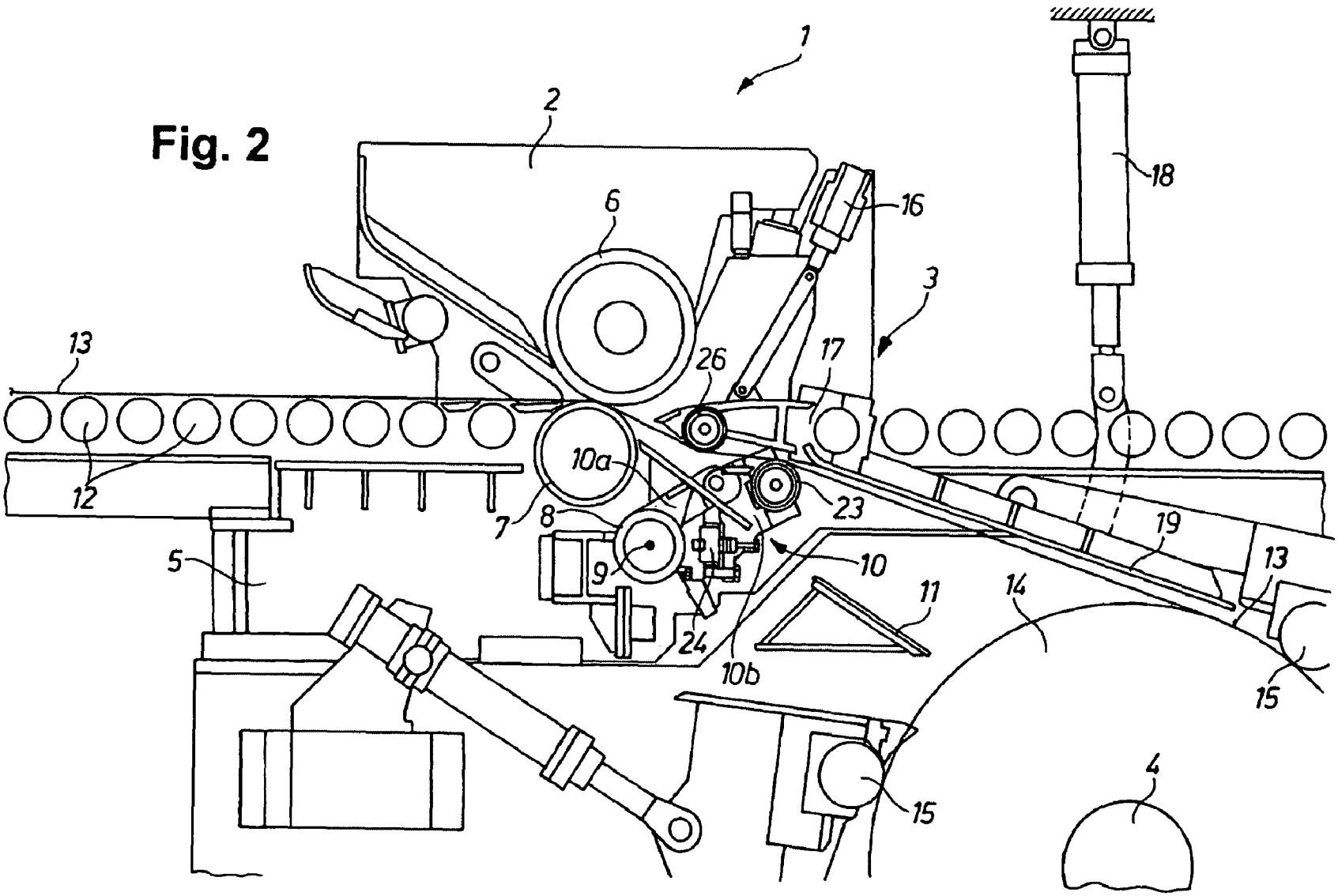
FIG. 2 shows the winding apparatus of FIG. 1 in the operating condition shortly before the end of a coil-winding process.

A winding apparatus shown in FIGS. 1 and 2 comprises a feeder 2 followed by a coiler 3 ending at a mandrel 4. A feeder frame 5 carries upper and lower feed rollers 6 and 7 as well as a pivotal strip-tension sensor 10 supported on a pivot shaft 8 with its axis 9 just downstream of the lower feed roller 7. A lower guide plate 11 is between the strip-tension sensor 10 and the mandrel 4, which lower guide plate also extends from the lower feed roller 7 to fill the empty space from there to the strip-tension sensor 10.

A metal strip 13 moves along the lower guide plate 11 from a finishing train (not shown) via a roller table 12, pulled by the feed rollers 6 and 7 through a feeder gap formed thereby to reach the mandrel 4 on which the metal strip 13 is wound to form a finished or wound coil 14, as indicated in FIG. 2 with maximum coil diameter. Several rollers 15 are juxtaposed with the mandrel 4 about its circumference. The coiler 3 is closed upward by a strip-diverting upper guide plate 17 extending from the starting position shown in FIG. 1 to the outer surface of the upper feed roller 6 and can be pivoted by a control cylinder 16, and a guide flap 19 extends from it to above the mandrel 4 and can be positioned by a pivot cylinder 18.

Figure 3:
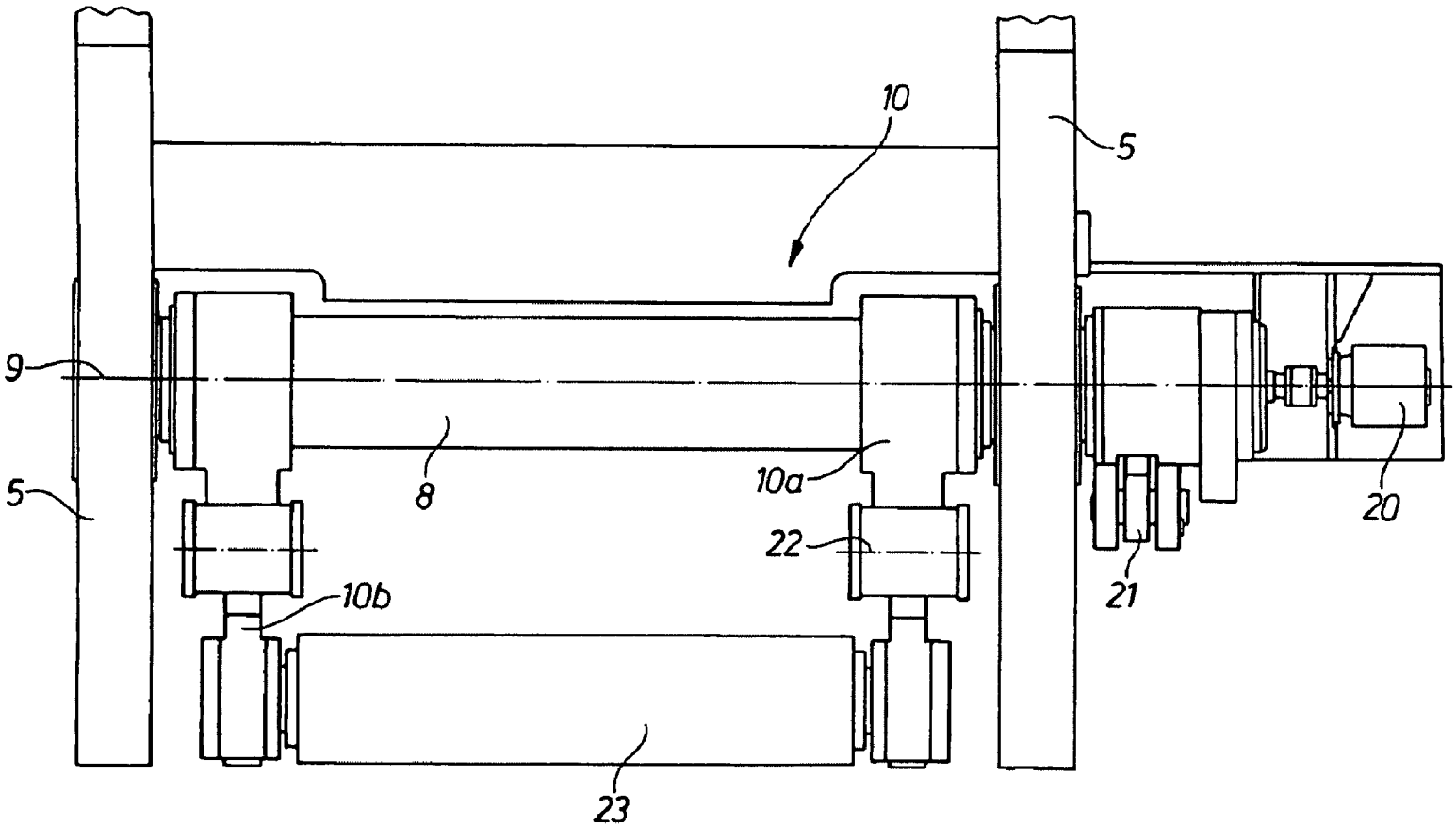
FIG. 3 is a detail of the winding apparatus with a pivotal strip-tension sensor in the feeder frame shown in diagrammatic view on the feeder frame.
Figure 5:
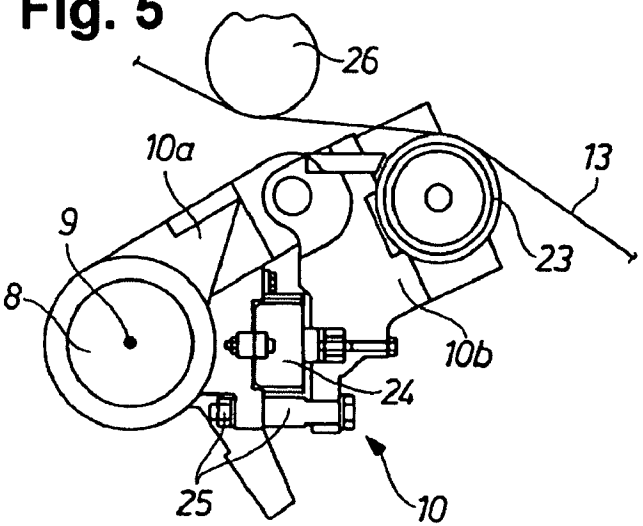
FIG. 5 shows the strip-tension sensor of FIG. 4 in an engaged position after build up of strip tension during the coil-winding process on the lower face of the strip.

The strip-tension sensor 10 supported in the feeder frame 5 can be pivoted about the pivot shaft 8 on the axis 9 by a hydraulic cylinder 21 attached with its lower end to the feeder frame 5 and having its own position sensor 20 (see FIG. 3). The strip-tension sensor 10, as can be seen in more detail from FIGS. 4 through 6, comprises an inner arm 10*a* supported with its inner end on the pivot shaft 8 and an outer arm 10*b* pivotally supported on its outer end at an axis 22. A driven (not shown) measuring roller 23 is supported on the outer end of the outer arm 10*b*. A force sensor 24, embodied as form of pressure-measurement cells, is provided in a space between the two arms 10*a* and 10*b* on the inner arm 10*a*. The two arms 10*a* and 10*b* are connected by a holder 25 allowing limited pivoting of the outer arm 10*b*.

Figure 4:
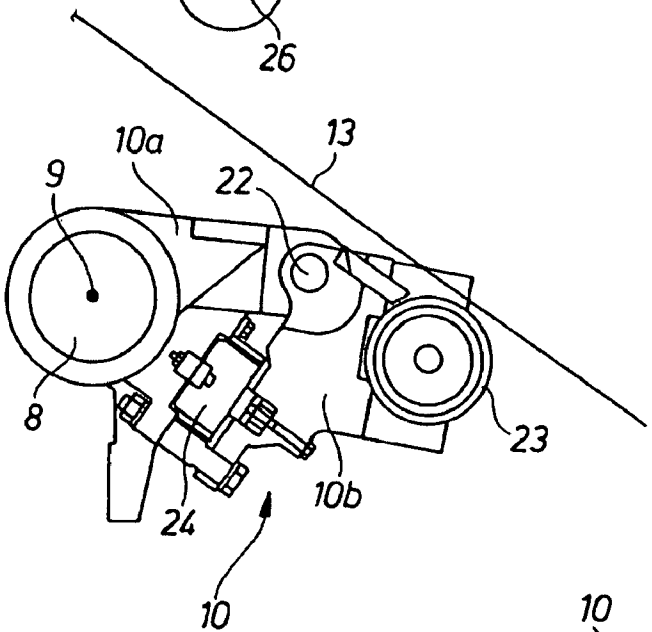
FIG. 4 is a detail in a partly sectional side view of the strip-tension sensor in the lowered position at the start of the coil winding process.

In the out-of-use position before a winding operation the strip-tension sensor 10 is in a pivoted-down lowered position as shown in FIGS. 1 and 4. As soon as the leading end or the start of the strip passes through the feeder gap between the upper and lower feed rollers 6 and 7 and has formed approximately two to three turns on the mandrel 4 with the help of the rollers 15 and thus the strip tension between the mandrel 4 and the feeder 2 has built up, the strip-tension sensor 10 is pivoted against the lower face of the metal strip into an accurately determined position hydraulically set by the hydraulic cylinder 21. A counter-pressure roller 26 (in FIG. 2 this is shown as a component of the upper guide plate 17) supported on the front end of the upper guide plate 17 is pivoted in from above and thus rotates oppositely to ensures enough of a contact angle of the metal strip 13 on the roller 23 for the measuring process.

The force applied to the roller 23 by the metal strip 13 is effective on the arm 10*b* and thus on the force sensor 24 of the first rear arm 10*a* in a clockwise direction. The force sensor(s) continuously monitor(s) the strip tension distribution with respect to strip nonplanarity. The outputs obtained are evaluated and transmitted to a controller of the feeder 2. This can be controlled based on the outputs, e.g. by pivoting the upper and/or the lower feed roller 6 and 7 or parallel pivoting of both rollers or by setting different closing forces on the drive side and operator side, such that a straight-edge coil 14 can form on the mandrel 4.

Figure 6:
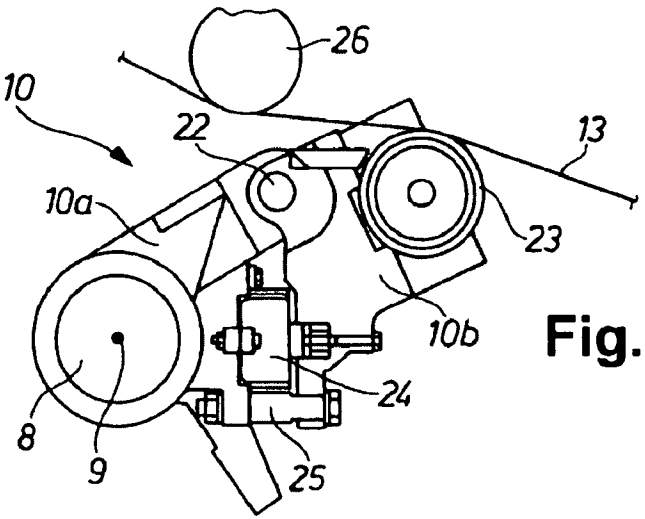
FIG. 6 shows the position of the strip-tension sensor according to FIG. 4 or 5 shortly before the end of the strip-winding process.

The apparatus position shortly before the end of the coil-winding process is shown by FIGS. 2 and 6. It can be seen that despite the growing coil diameter due to the adjustable position the contact angle between the metal strip 13 and the roller 23 of the strip-tension sensor 10 is unchanged. Shortly before the trailing end of the metal strip 13 leaves the feeder gap, monitoring is ended and the strip-tension sensor 10 returns to its starting position (see FIGS. 1 and 4), and the counter-pressure roller 26 is similarly pivoted up from the metal strip 13.

LIST OF REFERENCE NUMBERS

1 winding apparatus
2 Feeder
3 coiler
4 mandrel
5 Feeder frame
6 Upper feed roller
7 Lower feed roller
8 Pivot axis
9 Rotation point
10 strip-tension sensor
10*a* Inner arm
10*b* Outer arm
11 Lower guide plate
12 Roller table
13 Metal strip
14 Coil/wound coil
15 pinch roller
16 Operating cylinder
17 upper guide plate
18 Pivot cylinder
19 Guide flap
20 Position sensor
21 Hydraulic cylinder
22 Rotation axis
23 Roller/measuring roller
24 force sensor
25 Holder
26 counter-pressure means/counter-pressure roller

The invention claimed is:

1. A method of winding a metal strip onto a mandrel of a coiler, the method comprising the steps of:

feeding the metal strip past a strip-tension sensor roller engageable from below with the metal strip by a feeder having upper and lower feed rollers in a feeder frame with a lower guide plate provided below the metal strip and an upper guide plate and a pivoting guide flap above the metal strip extending from the upper guide plate to near the mandrel between the feed rollers and the mandrel;

determining longitudinal tension applied by the feeder to the metal strip to control the strip travel through the feeder by pivoting the strip-tension sensor roller mounted on the feeder frame about an axis just downstream of the lower feed roller from below upward into engagement with the metal strip; and pivoting a counter-pressure roller into engagement with the metal strip from above adjacent the strip-tension sensor roller and maintaining both the strip-tension sensor roller and the counter-pressure roller in contact with the strip during determination of the longitudinal tension.

2. The method according to claim 1 wherein the strip tension distribution is monitored across the width of the metal strip.

3. The method according to claim 1, further comprising the step, immediately after the strip is tensioned, of pivoting the strip-tension sensor roller up into engagement with the metal strip between the feeder and the mandrel in a controlled manner.

4. The method according to claim 3 wherein the strip-tension sensor roller is pivoted upward into engagement with the metal strip into a predetermined fixed position effective for the entire coil diameter.

5. The method according to claim 1, further comprising the step of measuring the transverse positions of edges of the metal strip.

6. The method according to claim 1 wherein the strip forms a contact angle between the sensor roller and the counter-pressure roller engaging downward with the metal strip.

7. The method according to claim 6, further comprising the step of:

rotating the sensor roller up to the speed of the metal strip before pivoting the sensor roller into engagement with the strip.

8. The method according to claim 1, further comprising the step of:

supplying results of the strip tensions measured downstream of the feeder are to a controller of an upstream finishing train.

9. The apparatus according to claim 8 wherein the counter-pressure roller is supported at the upstream end of the upper guide plate facing the upper feed roller.

10. The method defined in claim 1, further comprising the step, generally when a trailing end of the strip passes between the feed rollers, of:

retracting the sensor roller and the counter-pressure roller out of engagement with the strip.

11. In an apparatus for winding a metal strip onto a mandrel provided in a coiler to which the metal strip is fed, a feeder having upper and lower feed rollers in a feeder frame, a lower guide plate below the metal strip downstream of the rollers and upstream of the mandrel, an upper guide plate and a pivoting guide flap above the metal strip downstream of the rollers and upstream of the mandrel, the guide flap extending from the upper guide plate to near the mandrel, a strip-tension between the rollers and the mandrel and having an inner arm supported at its inner end at an axis on the feeder frame and an outer arm supported in a pivoted manner at an outer end of the inner arm and having having a sensor roller on its outer end, a force sensor being provided between the inner arm and the outer arm, and a counter-pressure roller pivotal against the metal strip from above between the feed rollers and the mandrel such that the metal strip is deflected upward by the sensor roller and downward by the counter-pressure roller.

12. The apparatus according to claim 11, further comprising pressure sensors as force sensor.

* * * * *